US010569539B2

(12) United States Patent
Hirasawa et al.

(10) Patent No.: US 10,569,539 B2
(45) Date of Patent: Feb. 25, 2020

(54) LIQUID EJECTION APPARATUS

(71) Applicant: SEIKO EPSON CORPORATION, Tokyo (JP)

(72) Inventors: Yusuke Hirasawa, Matsumoto (JP); Naomi Kimura, Okaya (JP); Shoma Kudo, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/194,746

(22) Filed: Nov. 19, 2018

(65) Prior Publication Data

US 2019/0152223 A1 May 23, 2019

(30) Foreign Application Priority Data

Nov. 22, 2017 (JP) ..... 2017-224385

(51) Int. Cl.
*B41J 2/14* (2006.01)
*B41J 2/165* (2006.01)

(52) U.S. Cl.
CPC ..... *B41J 2/14032* (2013.01); *B41J 2/16508* (2013.01); *B41J 2/16511* (2013.01); *B41J 2/16535* (2013.01); *B41J 2002/16502* (2013.01); *B41J 2002/16514* (2013.01)

(58) Field of Classification Search
CPC ..... B41J 2/16535; B41J 2/16511; B41J 2/16508; B41J 2/14032
USPC ..... 347/29, 32
See application file for complete search history.

(56) References Cited

U.S. PATENT DOCUMENTS 6,024,432 A 2/2000 Aruga et al.
7,963,632 B2 * 6/2011 Umeda ..... B41J 2/16511 347/29
9,358,794 B2 * 6/2016 Matsumoto ..... B41J 2/17596

FOREIGN PATENT DOCUMENTS

JP H10-119311 A 5/1998

* cited by examiner

*Primary Examiner* — An H Do
(74) *Attorney, Agent, or Firm* — Foley & Lardner LLP

(57) ABSTRACT

A liquid ejection apparatus has a liquid ejection head that has nozzles for ejecting liquid, a liquid container that has a liquid replenishing port through which the liquid is replenished from the outside, a plug member that can close the liquid replenishing port by being positioned at a closing position and open the liquid replenishing port by being positioned at an open position, a carriage configured to arrange the liquid ejection head and the liquid container, a cap configured to cap the nozzles so as to cover the nozzles, and a control unit, assuming that a state where the nozzles are covered by the cap is a capping state and a state where the nozzles are not covered by the cap is a non-capping state, configured to bring the nozzles and the cap into the non-capping state before removing the external container from the liquid replenishing port.

6 Claims, 9 Drawing Sheets

LIQUID EJECTION APPARATUS

BACKGROUND

1. Technical Field

The present invention relates to a liquid ejection apparatus.

2. Related Art

Conventionally, inkjet recording apparatuses including a recording head that is mounted in a carriage that moves reciprocally in the width direction of a recording medium, and discharges ink droplets from nozzle openings in a nozzle plate, an ink cartridge that supplies ink to the recording head, a capping means that seals the recording head in order for the recording head to remain able to discharge ink droplets, a cleaning member that abuts against the nozzle plate and performs wiping and rubbing, and a pump that supplies negative pressure to the capping means are known (for example, see JP-A-10-119311).

JP-A-10-119311 is an example of related art.

However, in a so-called on-carriage-type inkjet recording apparatus, when ink is replenished while an ink bottle or the like that contains replenishing ink is abutted against a liquid replenishing port of an ink cartridge in a state where a recording head is sealed by a capping means, pressure is applied on the capping means side. After that, when the ink bottle is separated from the ink cartridge, the pressure on the capping means side is released, the reaction travels to the nozzle side, and the nozzle meniscus is broken. There has been an issue where, if the nozzle meniscus is broken, an ink discharge failure occurs.

SUMMARY

The invention can be realized as the following modes or application examples.

Application Example 1

A liquid ejection apparatus according to this application example has a liquid ejection head that has a nozzle configured to eject a liquid, a liquid container that has a liquid replenishing port that is in communication with the liquid ejection head, and through which the liquid is replenished from an external container, a plug member that can close the liquid replenishing port by being positioned at a closing position and open the liquid replenishing port by being positioned at an open position, a carriage configured of arrange the liquid ejection head and the liquid container, a cap configured to cap the nozzle so as to cover the nozzle, and a control unit, assuming that a state where the nozzle is covered by the cap is a capping state and a state where the nozzle is not covered by the cap is a non-capping state, configured to bring the nozzle and the cap into the non-capping state before removing the external container from the liquid replenishing port.

According to this configuration, the liquid container is replenished with liquid in a non-capping state that is a state where the nozzle is not covered by the cap. Therefore, pressure is not applied to the nozzle during liquid replenishment. Accordingly, a nozzle meniscus formed in the nozzle is prevented from being broken, and the occurrence of a liquid discharge failure can be suppressed.

Application Example 2

In the liquid ejection apparatus according to the above-described application example, the carriage is configured to reciprocally move in a first direction, and before removing the external container from the liquid replenishing port, the control unit moves the carriage in the first direction to a position at which the nozzle and the cap come into a non-capping state.

According to this configuration, at the time of replenishing the liquid container with a liquid, the carriage can be reliably moved to a position at which the nozzle and the cap come into a non-capping state by moving the carriage in the first direction.

Application Example 3

In the liquid ejection apparatus according to the above-described application example, before removing the external container from the liquid replenishing port, the control unit further moves the carriage or the cap in a second direction that intersects the first direction, to a position at which the nozzle and the cap come into a non-capping state.

According to this configuration, the carriage or the cap can be reliably moved in a second direction that intersects the first direction to a position at which the nozzle and the cap come into a non-capping state. In this case, for example, by moving the carriage or the cap in the vertical direction, which is the second direction that intersects the first direction, the nozzle and the cap can be brought into a non-capping state.

Application Example 4

The liquid ejection apparatus according to the above-described application example further includes a housing that interferes with at least a portion of the plug member in the capping state in order to hinder opening/closing of the plug member, and does not interfere with the plug member in the non-capping state.

According to this configuration, the plug member interferes with the housing in a capping state, and thus the liquid replenishing port cannot be brought to the open position. Therefore, it is possible to prevent execution of liquid replenishment in a capping state. On the other hand, the plug member does not interfere with the housing in a non-capping state, and thus the liquid replenishing port can be brought to the open position, and liquid replenishment in a non-capping state can be executed. Accordingly, since liquid replenishment in a non-capping state is possible, pressure is not applied to the nozzle, and the nozzle meniscus can be prevented from being broken.

Application Example 5

In the liquid ejection apparatus according to the above-described application example, the carriage is configured to reciprocally move in a first direction, and before removing the external container from the liquid replenishing port, the control unit moves the carriage or the cap in a second direction that intersects the first direction to a position at which the nozzle and the cap come into a non-capping state.

According to this configuration, it is possible to reliably move the carriage or the cap in a second direction that intersects the first direction to a position at which the nozzle and the cap come into a non-capping state. In this case, for example, by moving the carriage or the cap in the vertical direction, which is the second direction that intersects first direction, the nozzle and the cap can be brought into a non-capping state.

Application Example 6

The liquid ejection apparatus according to the above-described application example further includes a timer that counts a non-capping time during which the nozzle and the cap are in the non-capping state, and the control unit determines whether or not it is necessary to clean the nozzle and a cleaning intensity according to the non-capping time counted by the timer, and executes cleaning.

According to this configuration, it is possible to determine whether or not to execute cleaning and control the cleaning intensity according to a period of time during which the nozzle and the cap were in a non-capping state. Accordingly, appropriate cleaning is executed, and the liquid discharge performance can be secured.

BRIEF DESCRIPTION OF THE DRAWINGS

The invention will be described with reference to the accompanying drawings, wherein like numbers reference like elements.

DESCRIPTION OF EXEMPLARY EMBODIMENTS

First, the configuration of a liquid ejection apparatus will be described.

Figure 1:
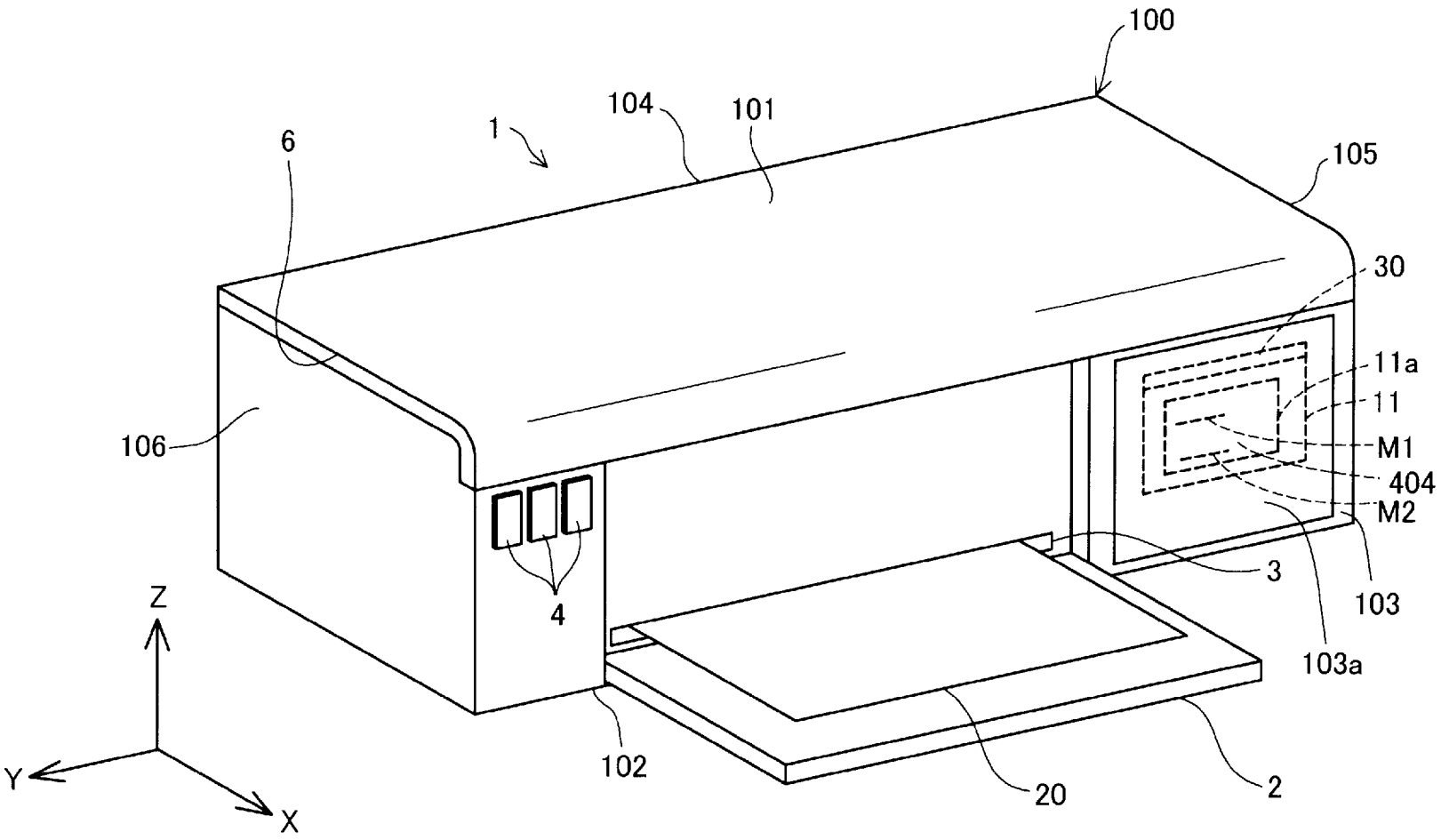
FIG. 1 is an external view showing the configuration of a liquid ejection apparatus.

FIG. 1 is an external view of a liquid ejection apparatus 1 that has a liquid tank as a mode of the invention. FIG. 1 shows three spatial axes orthogonal to each other, namely, an X axis, a Y axis, and a Z axis. A direction along the X axis is referred to as an "X axis direction", a direction along the Y axis is referred to as a "Y axis direction", and a direction along the Z axis is referred to as a "Z axis direction" (an up-down direction). The liquid ejection apparatus 1 is installed on a plane parallel to the X axis direction and the Y axis direction (an XY plane). A −Z axis direction is the vertical downward direction, and a +Z axis direction is the vertical upward direction. Also in other drawings to be described below, the X axis, Y axis, and Z axis are added as necessary.

The liquid ejection apparatus 1 is a so-called inkjet printer, and prints on a recording medium such as paper by ejecting ink as a liquid onto the recording medium. The liquid ejection apparatus 1 of this embodiment is a printer that performs monochrome printing using black ink (also simply referred to as "ink") as a liquid.

The liquid ejection apparatus 1 has an outer shell 100 that functions as a housing that forms the outer surface. The outer shell 100 has a substantially rectangular parallelepiped shape, and has an upper face (first face, first wall) 101, a lower face (second face, second wall) 102, a front face (third face, third wall) 103, a rear face (fourth face, fourth wall) 104, a right side face (fifth face, fifth wall) 105, and a left side face (sixth face, sixth wall) 106. The upper face 101 is opposed to the lower face 102 in the Z axis direction. The front face 103 is opposed to the rear face 104 in the X axis direction. The right side face 105 is opposed to the left side face 106 in the Y axis direction. The front face 103, the rear face 104, the right side face 105, and the left side face 106 are faces substantially vertical to an installation face of the liquid ejection apparatus 1. The upper face 101 and the lower face 102 are faces substantially horizontal to the installation face of the liquid ejection apparatus 1. Note that, in this embodiment, "substantially vertical" and "substantially horizontal" include "generally vertical" and "generally horizontal" as well as "perfectly vertical" and "perfectly horizontal". Accordingly, those faces 101 to 106 are not perfect flat faces, and allow for irregularities and the like, and it suffices for the faces 101 to 106 to appear "generally vertical" or "generally horizontal".

The liquid ejection apparatus 1 further has a front face cover 2, a discharge port 3, an operation unit 4, and an upper face cover 6. The front face cover 2 constitutes a portion of the front face 103, is axially supported at its lower end portion, and can be opened/closed by pivoting the upper end portion side. In FIG. 1, the front face cover 2 is in an open state. The discharge port 3 is exposed by opening the front face cover 2.

The discharge port 3 is a portion from which a recording medium is discharged. Note that a recording medium may be arranged in a tray provided on the rear face 104 side (not illustrated). Printing on the recording medium is executed by conveying the recording medium arranged on the tray into the outer shell 100 and ejecting liquid onto the recording medium.

The operation unit 4 consists of buttons that accept various operations from the user. For example, the various operations include an operation of starting printing of the liquid ejection apparatus 1, and an operation for executing an ink replenishing operation for replenishing a liquid tank 30, which will be described later, with ink from an external container.

The upper face cover 6 constitutes the upper face 101. The end portion of the upper face cover 6 on the rear face 104 side is axially supported, and the upper face cover 6 can be opened/closed by pivoting the front face 103 side. By opening the upper face cover 6, it is possible to check the internal state of the liquid ejection apparatus 1, perform a mounting/removing operation of the liquid tank 30, and replenish (inject) liquid into a liquid tank, which will be described later.

A window portion 103*a* of the apparatus is formed in a region in the front face 103 overlapping a home position of a carriage 19 in the Y axis direction (the direction of reciprocal movement of the carriage 19 to be described later). In this embodiment, the window portion 103*a* of the apparatus is arranged at a position different from that of the front face cover 2, and is arranged on the −Y axis direction side relative to the front face cover 2. The window portion 103*a* of the apparatus is provided in order to allow the user to visually recognize, from the outside, a front face (visual recognition face) 404 of the liquid tank 30 as a liquid container mounted on the carriage 19 positioned at the home position. In addition, signs M1 and M2 are provided in the front face 404. For example, the window portion 103*a* of the apparatus may be a through hole that penetrates the front face 103, or may be a transparent member. The signs M1 and M2 are elements for indicating references for the level of liquid contained in the liquid tank 30, and, in this embodiment, the sign M1 indicates a reference of an upper limit, and the sign M2 indicates a reference of a lower limit. The signs M1 and M2 will be described later in detail. Note that as long as the front face 404 of the liquid tank 30 at the home position can be visually recognized from the outside, the window portion 103*a* of the apparatus does not need to be provided in the front face 103. For example, the window portion 103*a* of the apparatus may be provided in the upper face 101. In this case, the user can visually recognize the front face 404 of the liquid tank 30 by visually recognizing the window portion 103*a* of the apparatus from above and front on.

Figure 2:
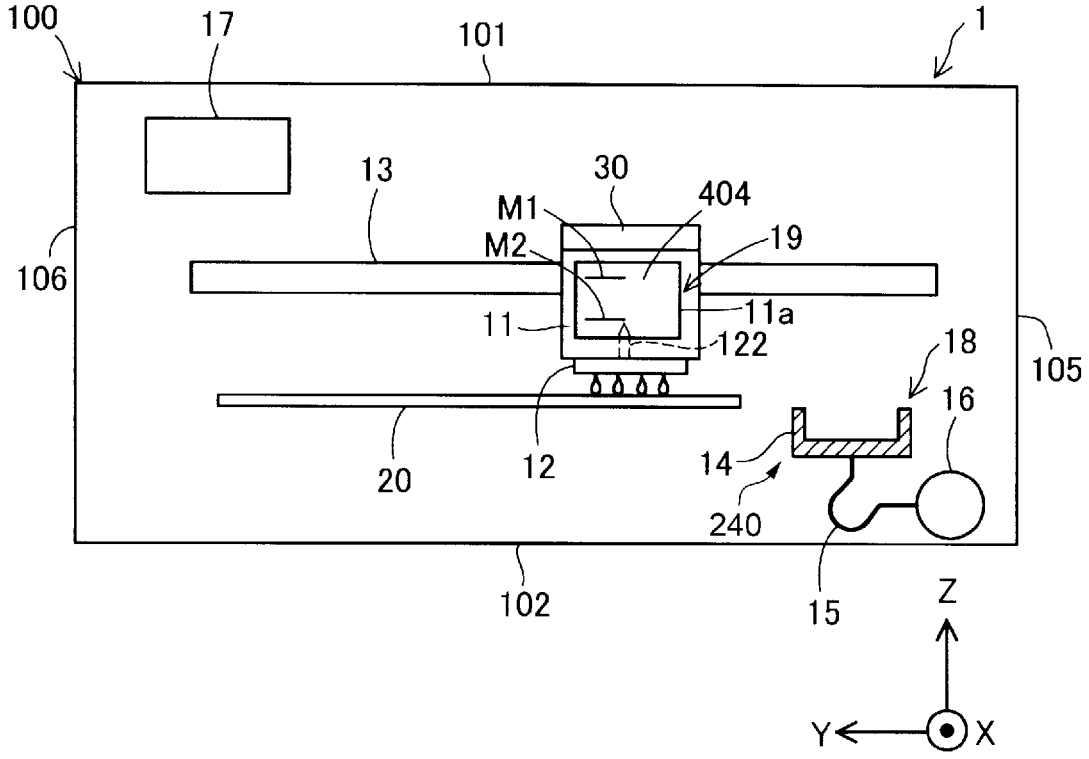
FIG. 2 is a schematic diagram showing the internal configuration of a liquid ejection apparatus.

FIG. 2 is a schematic diagram showing the internal configuration of the liquid ejection apparatus 1. The liquid ejection apparatus 1 has, inside the outer shell 100, a control unit 17, the carriage 19 provided with a liquid ejection head 12, and the liquid tank 30 that is detachably mounted on the carriage 19. The control unit 17 controls various operations (e.g., a printing operation) of the liquid ejection apparatus 1.

The carriage 19 has a mounting portion 11 arranged on the liquid ejection head 12. For example, the mounting portion 11 has a recessed shape that is open in the +Z axis direction, and forms a mounting space in which the liquid tank 30 is mounted. The mounting portion 11 has a liquid introduction needle portion 122 protruding in the +Z axis direction from a lower face that defines the mounting space. The liquid introduction needle portion 122 is connected to the liquid tank 30. The liquid introduction needle portion 122 is hollow, and a communication hole for communication with the inside of the liquid introduction needle portion 122 is formed on the tip end side thereof. Liquid that is supplied from the liquid tank 30 via the communication hole of the liquid introduction needle portion 122 flows inside the liquid introduction needle portion 122. The liquid ejection head 12 has a plurality of nozzles and driving means (e.g., piezoelectric elements) corresponding to the respective nozzles. The liquid ejection head 12 is in communication with the liquid introduction needle portion 122, and ejects ink (in this embodiment, black ink) as a liquid supplied from the liquid tank 30, from the nozzles onto a recording medium 20 (e.g., printing paper).

In addition, the mounting portion 11 has a window portion 11*a* of the mounting portion for the user to visually recognize the front face (visual recognition face) 404 including the signs M1 and M2. The window portion 11*a* of the mounting portion is provided at least at a position opposed to the sign M1 of the liquid tank 30. For example, the window portion 11*a* of the mounting portion may be a through hole that penetrates a wall that forms the mounting portion 11, or may be a transparent member. In the case where the carriage 19 is positioned at the home position, the user can visually recognize the front face 404 (visual recognition face) with the signs M1 and M2 via the window portion 103*a* of the apparatus (FIG. 1) and the window portion 11*a* of the mounting portion.

The carriage 19 equipped with the liquid ejection head 12 is driven by a driving mechanism (not illustrated, and including a driving motor as a driving means), and repeats reciprocal movement above the recording medium 20 while being guided by a guide rail 13 extending in the Y axis direction (first direction). In addition, the liquid ejection apparatus 1 has a conveyance mechanism (not illustrated) including a conveyance roller for conveying the recording medium 20 toward the discharge port 3 (FIG. 1), a driving motor, and the like. An image or the like is printed onto the recording medium 20 by ejecting liquid from the liquid ejection head 12 in accordance with the movement of the carriage 19 that reciprocally moves, and movement of conveyance of the recording medium 20.

The liquid tank 30 contains liquid to be supplied to the liquid ejection head 12. In this embodiment, the contained liquid is black ink, and is ink in which pigment particles are dissolved in a solvent. The liquid tank 30 is detachably connected to the liquid introduction needle portion 122. By connecting the liquid tank 30 to the liquid introduction needle portion 122, liquid in the liquid tank 30 can flow to the liquid introduction needle portion 122.

The liquid ejection apparatus 1 further has a discharge portion 18 that executes an operation (discharging operation) of periodically sucking out a fluid (e.g., liquid or air) from the liquid ejection head 12.

The discharge portion 18 is arranged inside the outer shell 100. The discharge portion 18 includes a cap 14, a suction tube 15, and a suction pump 16. While the liquid ejection apparatus 1 is not performing a printing operation, the carriage 19 is arranged at the home position that is out of a movement region of a printing operation.

The cap 14 is a member arranged below the home position and shaped like a bottomed box. The cap 14 is connected to a cap elevation unit 240 (see FIG. 4) that can be raised and lowered by a driving motor acting as a driving means, and can move in the Z axis direction (the vertical direction (the up-down direction)). The cap 14 presses against the lower face of the liquid ejection head 12 by moving upward. Accordingly, the cap 14 forms a closed space such that nozzle holes formed in the lower face of the liquid ejection head 12 are covered. In other words, a closed space state is formed by the cap 14 capping the nozzles of the liquid ejection head 12 so as to cover the nozzles. It is possible to suppress the drying of ink in the liquid ejection head 12 (nozzles) by using this closed space.

Note that the nozzles of the liquid ejection head 12 are capped by the cap 14 such that the nozzles are covered, when printing is not being performed.

The suction tube 15 allows the cap 14 (specifically, a through hole formed in the bottom face of the cap 14) and the suction pump 16 to be in communication with each other. The suction pump 16 sucks fluid (liquid or air) in the liquid ejection head 12 or the liquid tank 30 via the suction tube 15 by being driven in the closed space state. Initial filling of the liquid ejection head 12 with liquid can be performed in this manner, and deteriorated liquid (dried and thickened liquid) in the liquid ejection head 12 can be sucked out.

Figure 3:
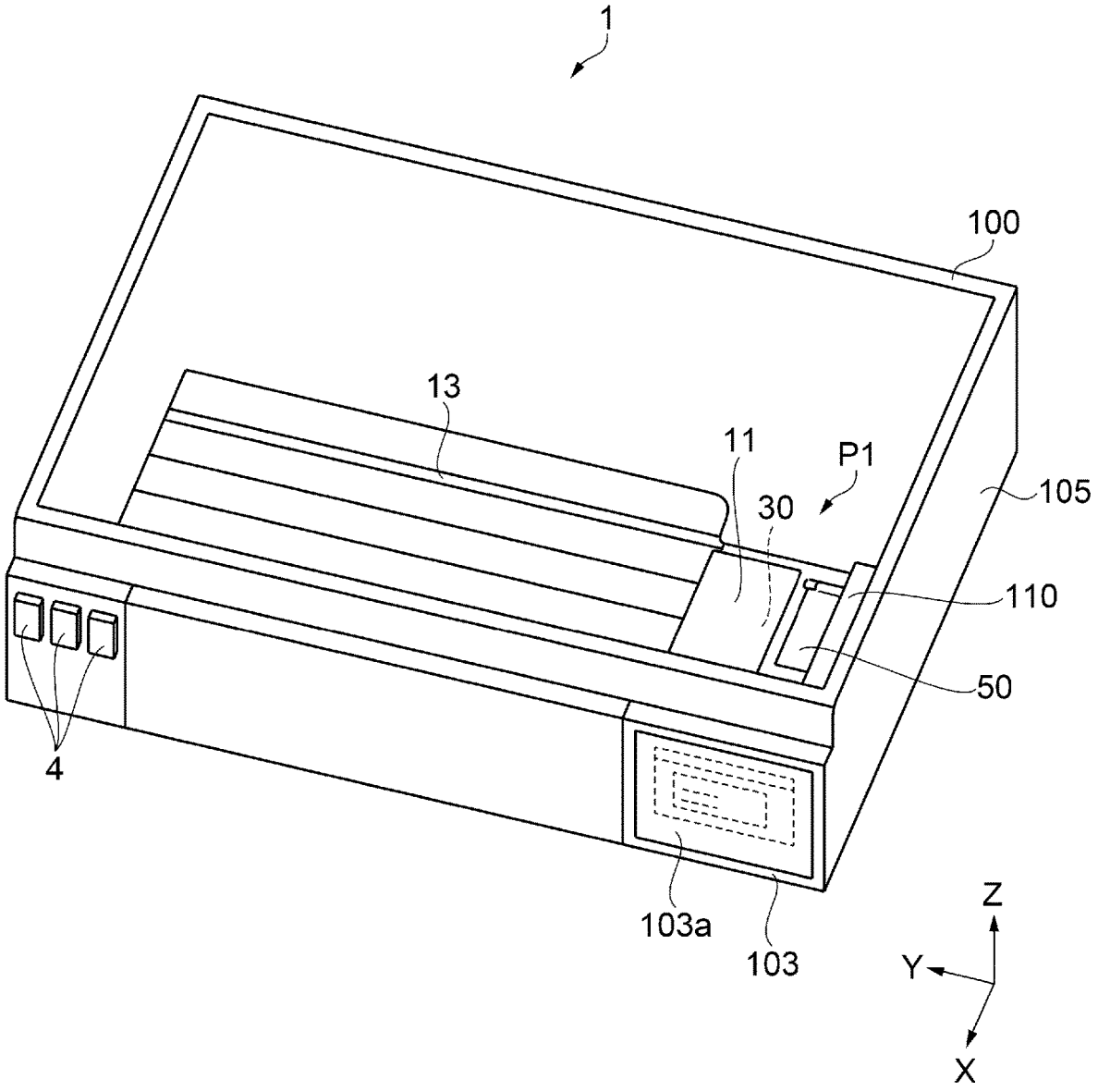
FIG. 3 is a schematic diagram showing the configuration of the liquid ejection apparatus with its upper cover removed.
Figure 4:
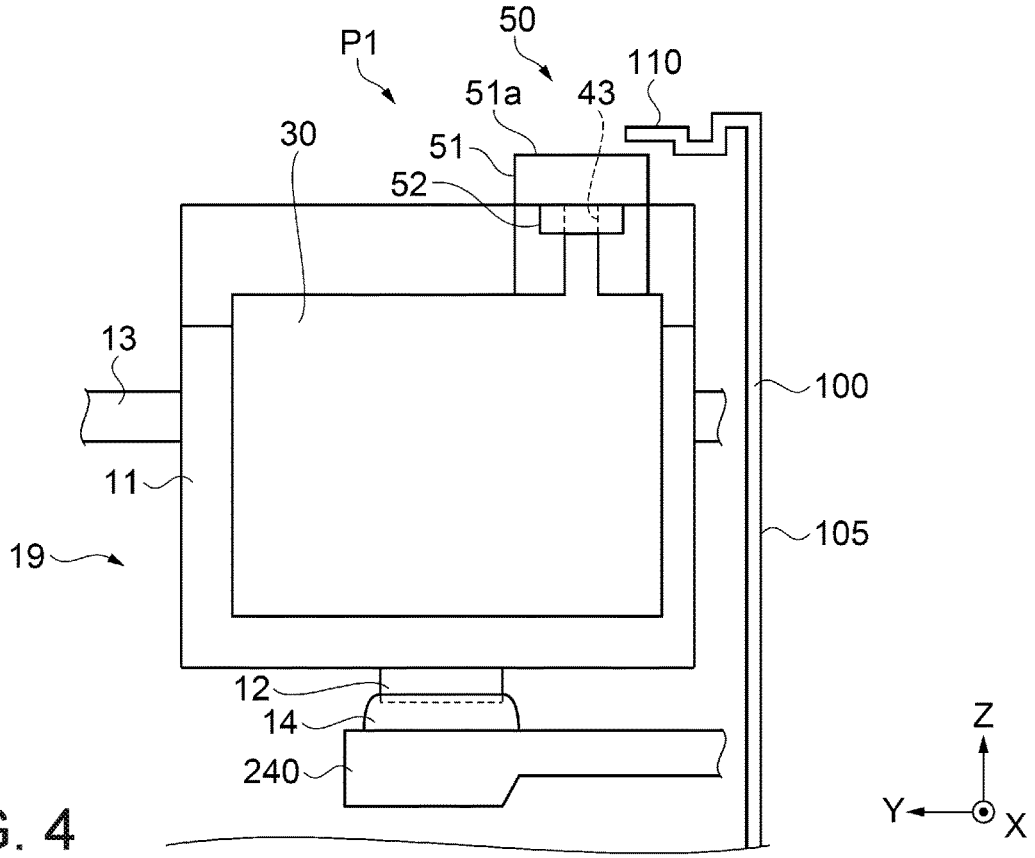
FIG. 4 is a schematic diagram showing the configuration of the liquid ejection apparatus in a capping state.
Figure 5:
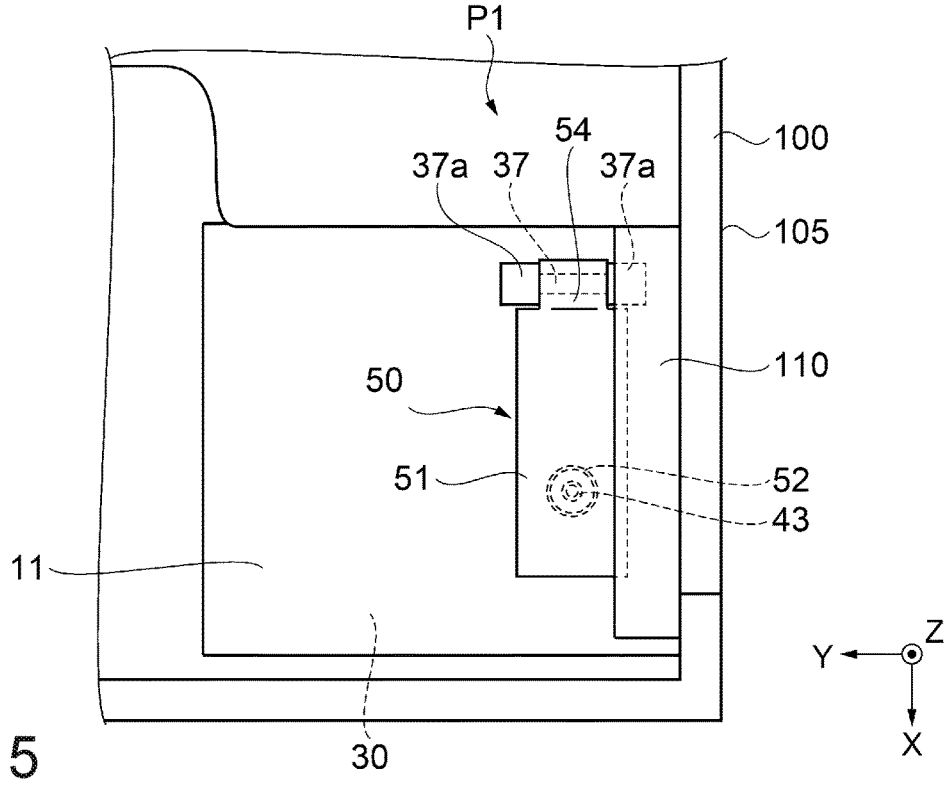
FIG. 5 is a schematic diagram showing the configuration of the liquid ejection apparatus in a capping state.

FIG. 3 is a schematic diagram showing the configuration of a liquid ejection apparatus in a state where the upper face cover 6 is removed. FIGS. 4 and 5 are schematic diagrams showing the configuration of a liquid ejection apparatus in a capping state.

As shown in FIGS. 3 to 5, a projection 110 protruding inward of the outer shell 100 is provided in a portion of the outer shell 100. In this embodiment, the projection 110, which has a substantially plate-like shape, is provided in the corner at which the right side face (fifth face, fifth wall) 105 and the front face 103 intersect each other, and is positioned along an upper portion of the right side face (fifth face, fifth wall) 105.

In addition, as shown in FIG. 4, a liquid replenishing port 43 for replenishing ink from the outside is provided in an upper portion of (in the +Z axis direction relative to) the liquid tank 30 in a state where the liquid tank 30 is mounted in the mounting portion 11 of the carriage 19. In addition, a plug member 50 that can close the liquid replenishing port 43 when it is at a closing position, and open the liquid replenishing port 43 when it is at an open position is provided. Here, FIGS. 4 and 5 show a state where the liquid replenishing port 43 is closed by the plug member 50 at the closing position. The plug member 50 is attached to the upper face of the mounting portion 11. Specifically, as shown in FIG. 5, a shaft portion 37 is provided at an end portion on the depth direction (the −X axis direction) side of the upper face of the mounting portion 11. The shaft portion 37 is installed in a state of being sandwiched on its two sides in the axial direction by supporting portions 37*a* each having a portion with a larger diameter than that of the shaft portion 37, and extending horizontally in the Y axis direction.

The plug member 50 has an elastically deformable plug body 52 that covers the liquid replenishing port 43 and a holding member 51 that holds the plug body 52. The holding member 51 has a shape that is elongated in one direction. An engagement portion 54 that can engage with the shaft portion 37 is provided at one end of the holding member 51. The width of the engagement portion 54 is somewhat shorter than the axial length of the shaft portion 37. In addition, the engagement portion 54 is shaped like the letter C in cross section with a portion of a ring cut away, and when the opening of the engagement portion 54 is placed on and pressed against the shaft portion 37, the engagement portion 54 is engaged with the shaft portion 37. In a state of being engaged with the shaft portion 37, the engagement portion 54 is sandwiched on its two sides in the axial direction by the pair of supporting portions 37*a*, and deviation of the plug member 50 in the Y axis direction is restricted. Therefore, when the plug member 50 is moved from the open position to the closing position, the plug body 52 is positioned relative to the liquid replenishing port 43.

The plug body 52 is arranged on an end portion side opposite to the engagement portion 54 of the holding member 51. The user can perform an opening/closing operation of the plug member 50 by gripping, with his or her fingers, the end portion on the side opposite to the engagement portion 54 of the holding member 51. Accordingly, liquid on the plug body 52 is unlikely to adhere to the fingers.

Note that the holding member 51 is formed of a non-flexible member, and the plug body 52 is formed of a flexible member. The material of the non-flexible member may be plastic, metal, or the like. The material of the flexible member may be rubber, elastomer, or the like. In addition, the shaft portion 37, the mounting portion 11, and the liquid tank 30 are formed of non-flexible members. As a material of the liquid tank 30, a material that is compatible with the properties of ink contained therein and can exert a function desired for the liquid tank 30 is preferably selected. Note that the materials of the holding member 51, the shaft portion 37, and the mounting portion 11 may be the same or different.

Moreover, as shown in FIGS. 4 and 5, when the carriage 19 is at a position P1 (the home position) and thereby a capping state is entered in which the nozzle of the liquid ejection head 12 is capped by the cap 14, a portion of the plug member 50 and the projection 110 that is provided in the outer shell 100 interfere with each other in order to obstruct opening/closing of the plug member 50. Accordingly, as shown in FIG. 5, in planar view in a capping state (the position P1), the projection 110 is arranged above the plug member 50 such that a portion of the plug member 50 and the projection 110 overlap.

Therefore, as shown in FIG. 4, in a capping state, even if an attempt is made to move the plug member 50 upward (the +Z axis direction), an upper face 51*a* of the plug member 50 comes into contact with the projection 110, and thus upward movement of the plug member 50 is restricted. Therefore, in a capping state, the liquid replenishing port 43 and the plug body 52 cannot be separated from each other (the plug member 50 is held at a closing position), and thus it is not possible to replenish ink from the outside through the liquid replenishing port 43.

FIGS. 6 to 9 are schematic diagrams showing the configuration of a liquid ejection apparatus in a non-capping state.

Figure 6:
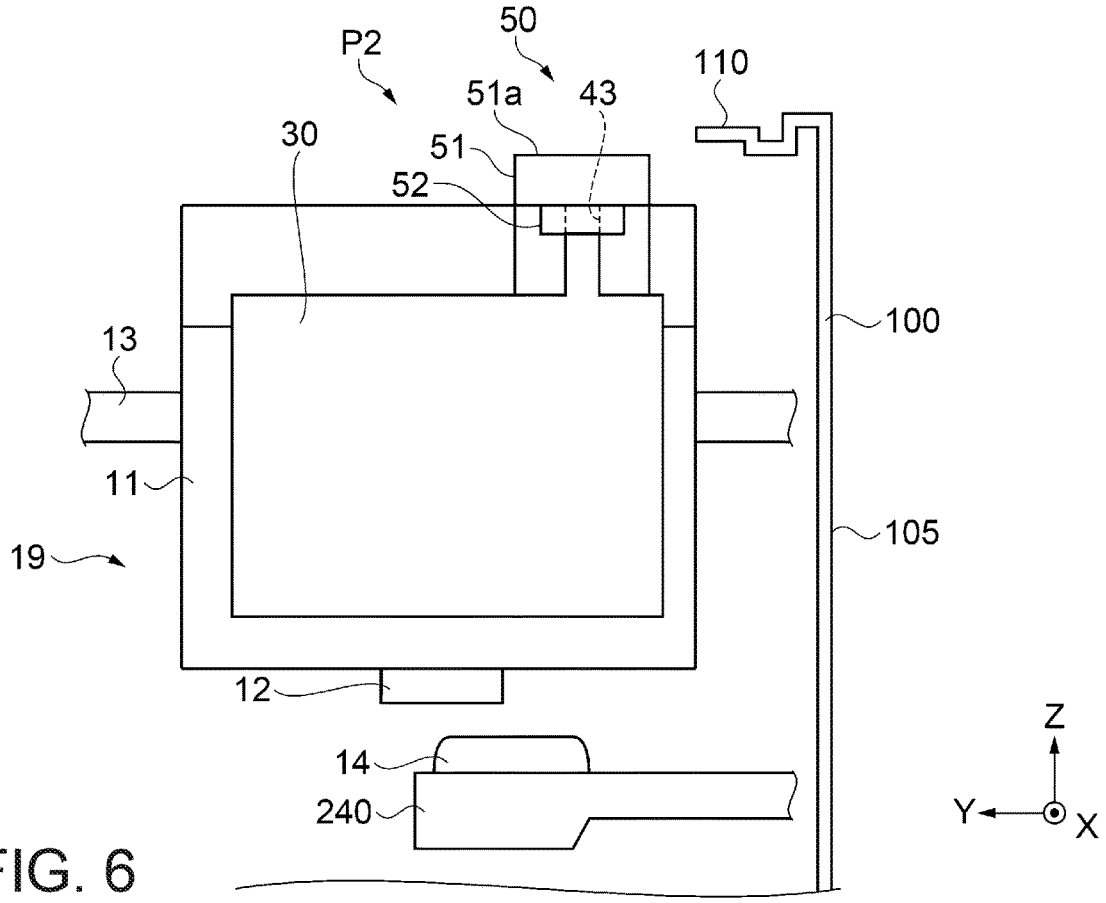
FIG. 6 is a schematic diagram showing the configuration of the liquid ejection apparatus in a non-capping state.
Figure 7:
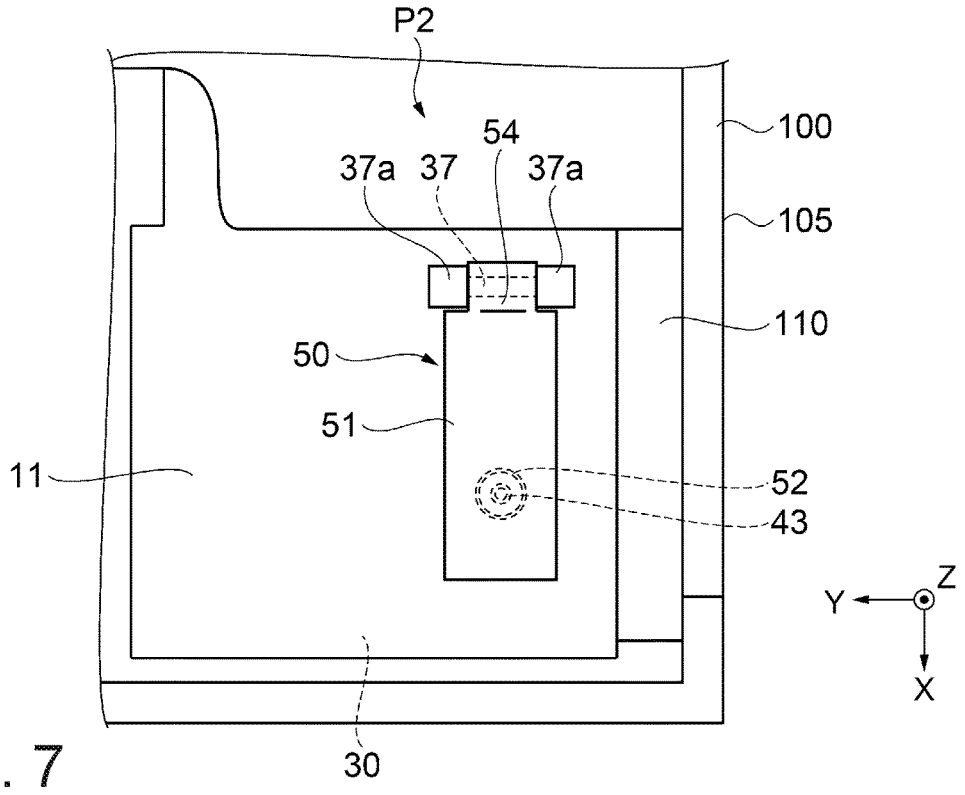
FIG. 7 is a schematic diagram showing the configuration of the liquid ejection apparatus in a non-capping state.

As shown in FIGS. 6 and 7, by moving from the position P1 for a capping state to a position P2 for bringing the nozzles and the cap 14 into a non-capping state where the nozzles are not covered by the cap 14, a state is entered in which ink can be replenished through the liquid replenishing port 43 from the outside. Accordingly, the position P2 for bringing the nozzles and the cap 14 into a non-capping state is a position for allowing the plug member 50 to move to an open position. Accordingly, as shown in FIG. 7, in a non-capping state (the position P2), the entire plug member 50 and the projection 110 do not overlap.

Figure 8:
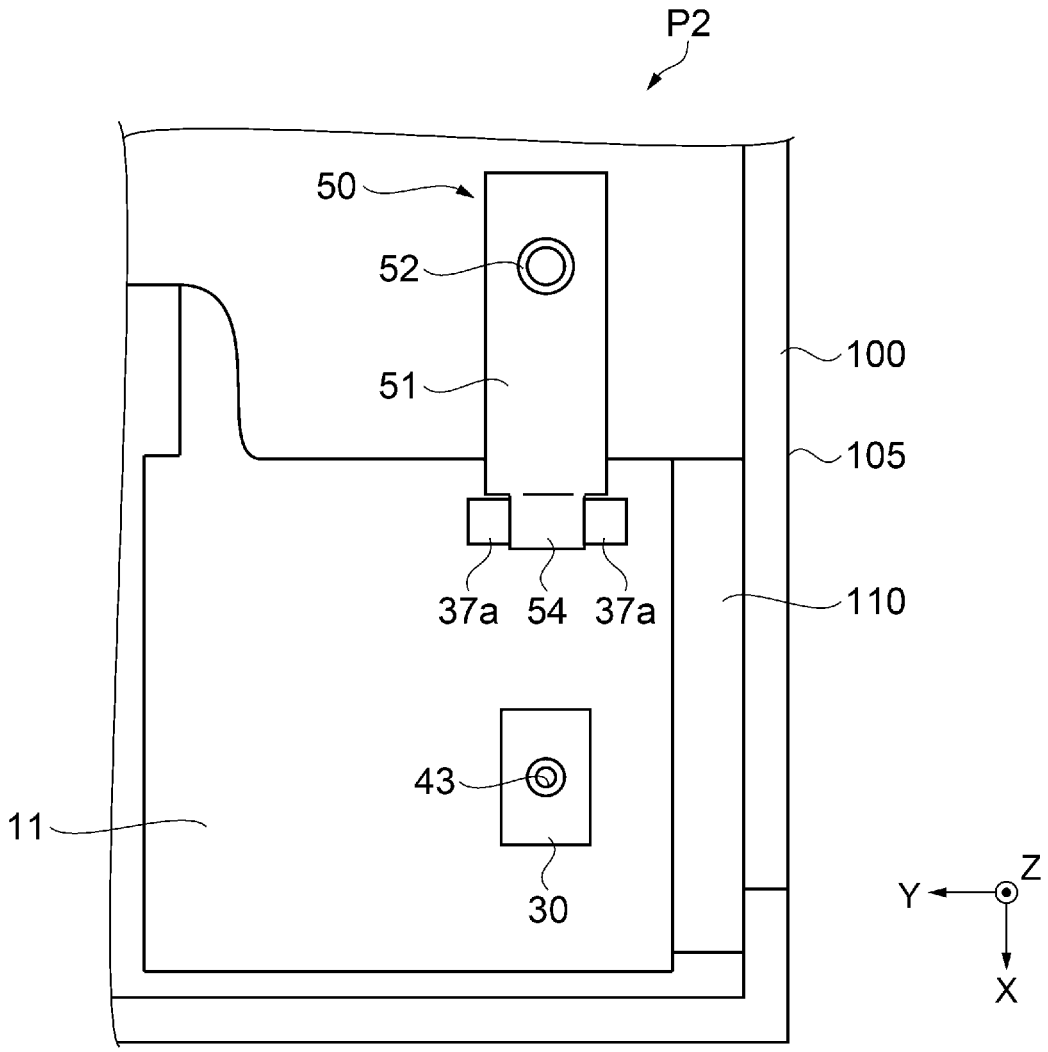
FIG. 8 is a schematic diagram showing the configuration of the liquid ejection apparatus in a non-capping state.
Figure 9:
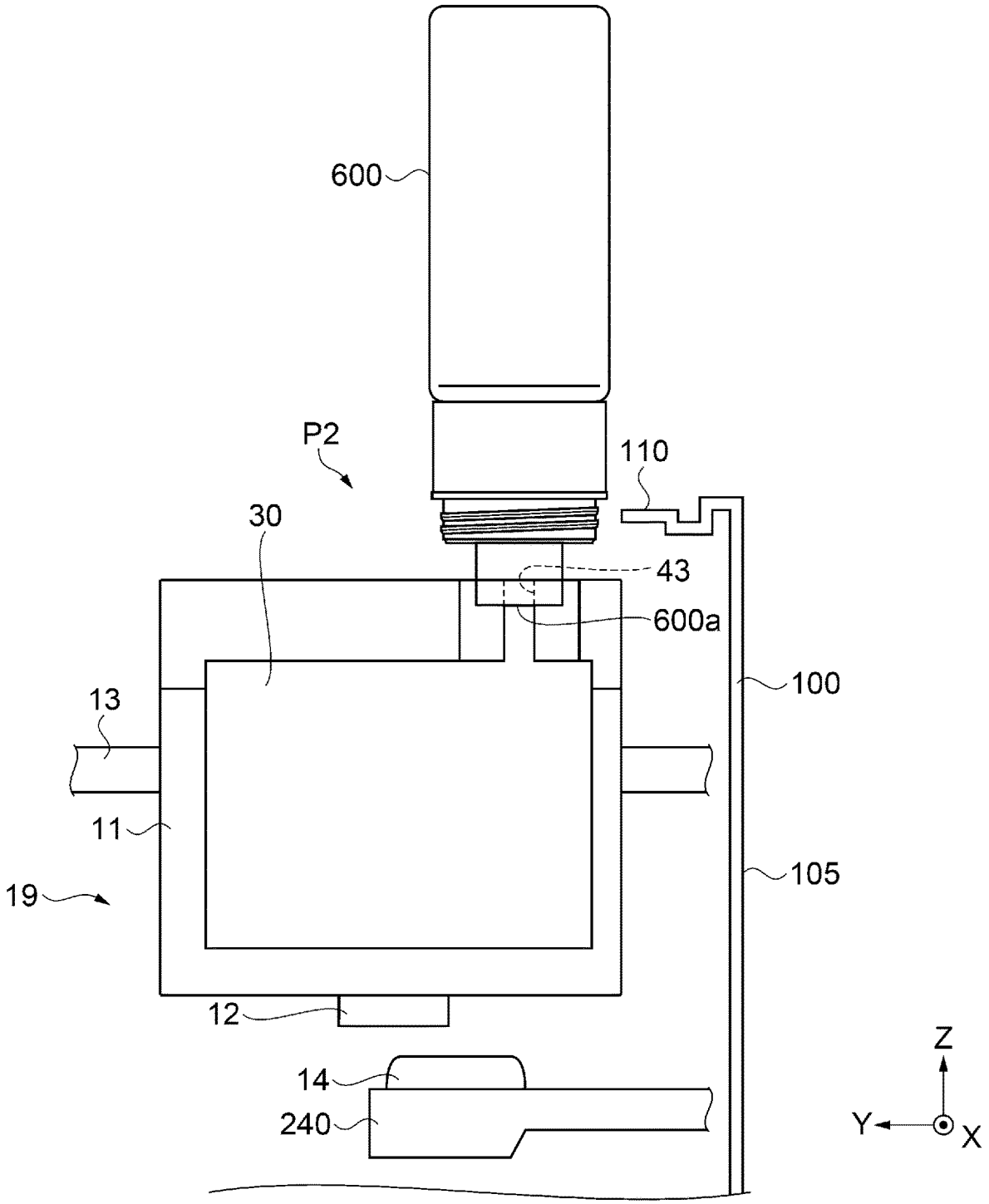
FIG. 9 is a schematic diagram showing the configuration of the liquid ejection apparatus in a non-capping state.

Therefore, as shown in FIG. 6, in a non-capping state, when moving the plug member 50 upward (the +Z axis direction), the upper face 51*a* of the plug member 50 does not come into contact with the projection 110, and as shown in FIG. 8, it is possible to move the plug member 50 to an open position by rotationally moving the plug member 50 about the shaft portion 37. Accordingly, in a non-capping state, the liquid replenishing port 43 and the plug body 52 can be separated from each other, and thus, in a state where the plug member 50 is kept at the open position, as shown in FIG. 9, it is possible to replenish the liquid tank 30 with ink while connecting, to the liquid replenishing port 43, an ink outlet portion 600*a* of an ink bottle 600 (an external container) that contains replenishing ink, for example. Note that the form of the ink bottle 600 for replenishing the liquid tank 30 with ink is not particularly limited, and, for example, the ink bottle 600 may have a different ink capacity, or the height and the diameter of the ink bottle 600 may be different.

Therefore, the liquid tank 30 is replenished with ink in a non-capping state that is a state where the nozzles are not covered by the cap 14, and thus pressure is not applied to the cap 14 due to pressurization at the time of ink replenishment, ink is replenished in a state where the nozzles are open, and thus pressure is not applied to the nozzles, making it possible to prevent the nozzle meniscus from being broken.

Next, the configuration of the control unit of the liquid ejection apparatus will be described.

Figure 10:
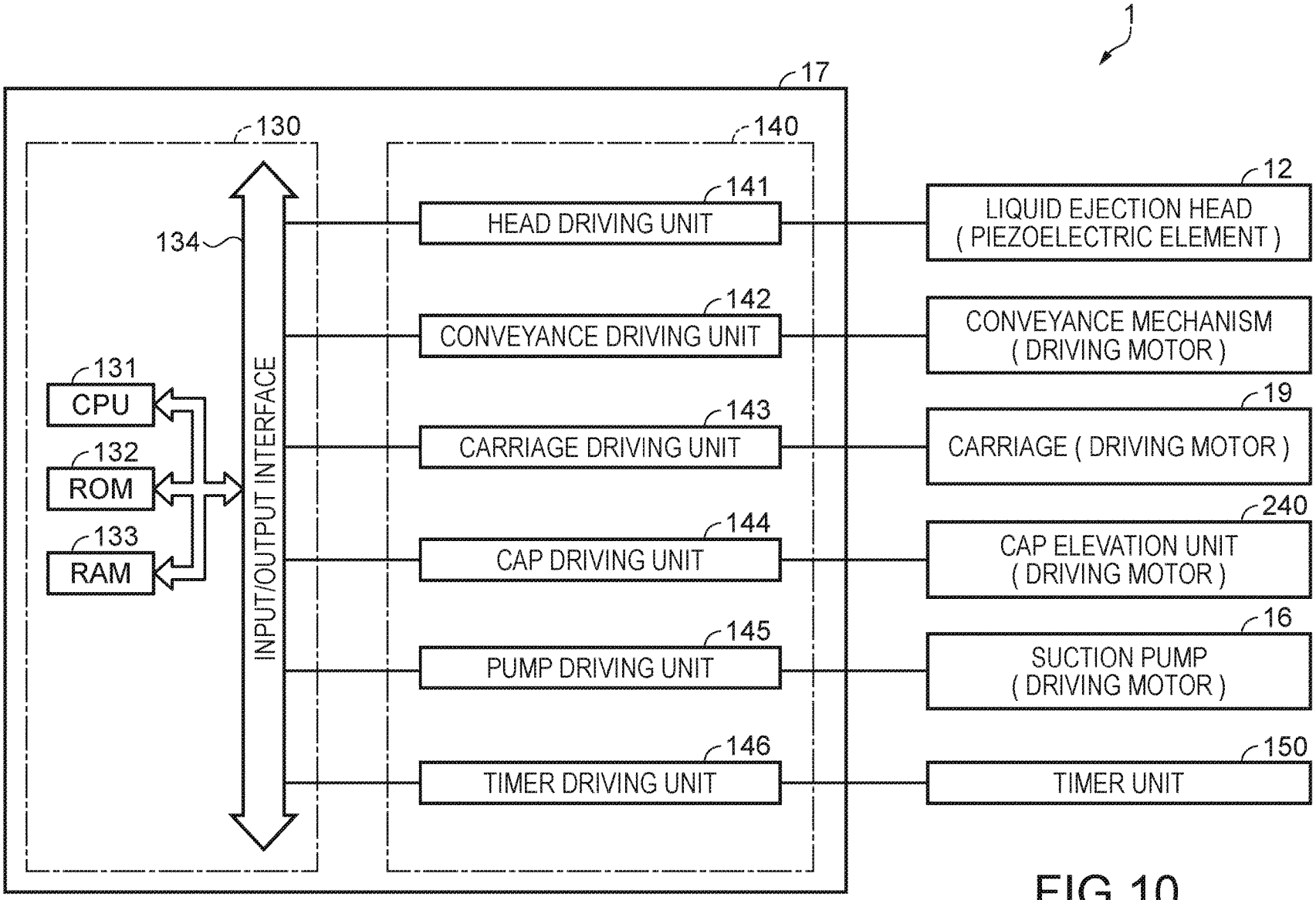
FIG. 10 is a block diagram showing the configuration of a control unit of the liquid ejection apparatus.

FIG. 10 is a block diagram showing the configuration of the control unit of the liquid ejection apparatus. As shown in FIG. 10, the control unit 17 has an instruction unit 130, a driving unit 140, and the like. The instruction unit 130 is constituted by a CPU 131, a ROM 132 serving as a storage means, a RAM 133, and an input/output interface 134, and the CPU 131 processes various signals that are input via the input/output interface 134 based on data in the ROM 132 and the RAM 133, and outputs control signals to the driving unit 140 via the input/output interface 134. The CPU 131 performs various types of control based on control programs stored in the ROM 132, for example.

The driving unit 140 is constituted by a head driving unit 141, a conveyance driving unit 142, a carriage driving unit 143, a cap driving unit 144, a pump driving unit 145, a timer driving unit 146, and the like. The head driving unit 141 controls the liquid ejection head 12 (e.g., piezoelectric elements) based on a control signal from the instruction unit 130. In addition, the conveyance driving unit 142 controls the conveyance mechanism (driving motor). The carriage driving unit 143 controls the carriage 19 (driving motor). The cap driving unit 144 controls the cap elevation unit 240 (driving motor). The pump driving unit 145 controls the suction pump 16 (driving motor). In addition, the timer driving unit 146 controls a timer unit 150. Note that the timer unit 150 is a timer that can count time. In addition, the timer unit 150 has a calendar function for being able to measure the time and date, and the like.

In such a configuration, before removing an external container from the liquid replenishing port 43, the control unit 17 brings the nozzles and the cap 14 into a non-capping state.

Specifically, before removing an external container from the liquid replenishing port 43, the control unit 17 moves the carriage 19 in the Y axis direction, which is the first direction, to a position at which the nozzles and the cap 14 come into a non-capping state. In addition, at this time, the cap 14 is moved in a second direction (the Z axis direction (the vertical direction in an in-use state)) intersecting the first direction (the Y axis direction).

Note that, in the case of a non-capping state, the carriage 19 may be moved in the second direction (the Z axis direction (the vertical direction in an in-use state)).

Furthermore, the control unit 17 determines whether or not the nozzles need to be cleaned, and determines the cleaning intensity according to the length of time of a non-capping state counted by the timer unit 150 (a non-capping time), and executes cleaning. Note that the cleaning intensity is defined based on a period of time during which the suction pump 16 sucks a fluid (liquid or air) in the liquid ejection head 12, for example.

Figure 11:
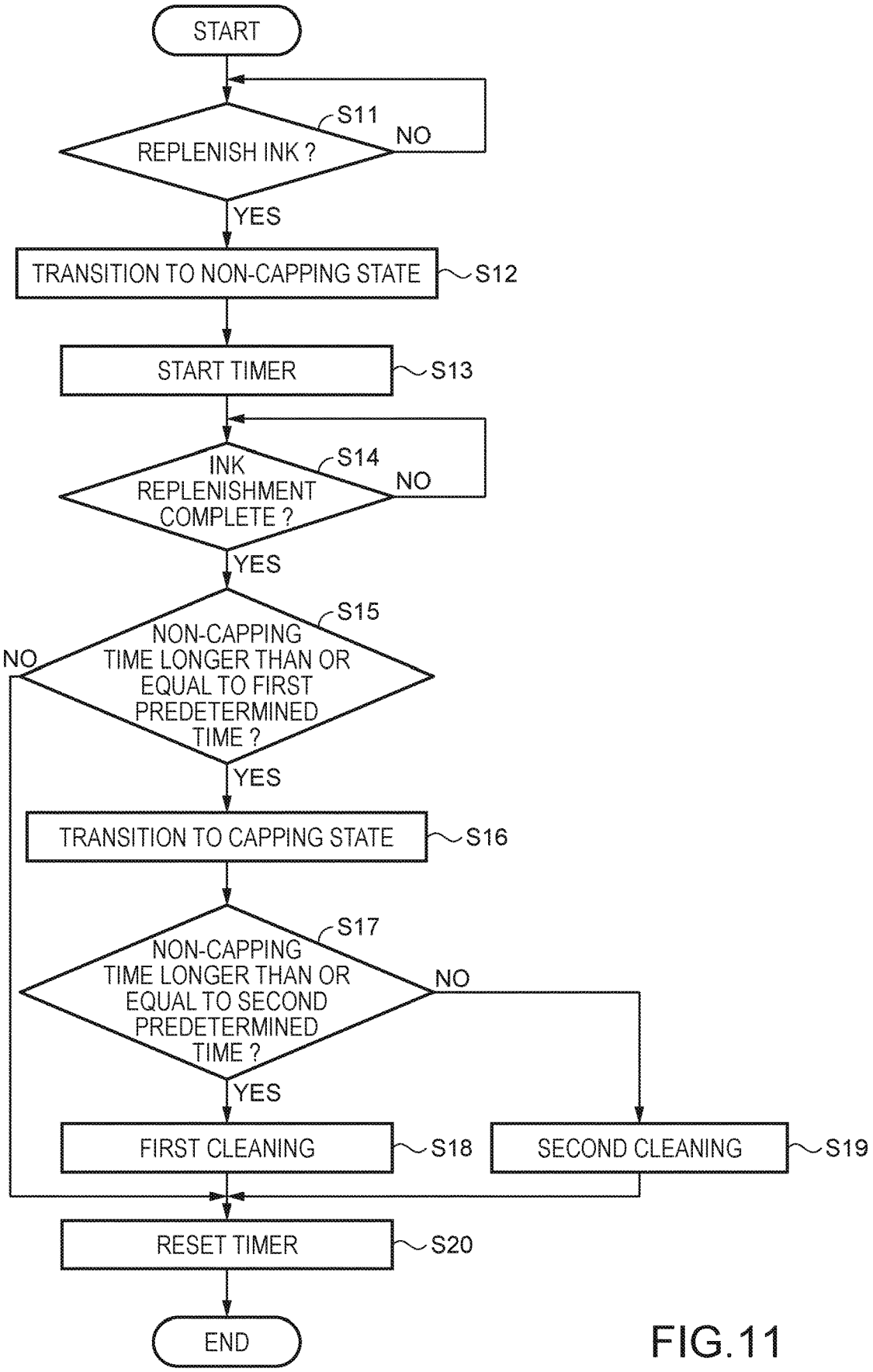
FIG. 11 is a flowchart showing a control method of the liquid ejection apparatus.

Next, a control method of the liquid ejection apparatus 1 will be described. Specifically, control related to replenishment of the liquid ejection apparatus 1 with ink and a control method for cleaning the liquid ejection head 12 during ink replenishment will be described. FIG. 11 is a flowchart showing a control method of a liquid ejection apparatus. Note that, in this embodiment, a control method from a state where the carriage 19 is moving toward the home position, in other words, a state where the carriage 19 is positioned at the position P1, and a capping state has been entered, will be described.

First, in step S11, it is determined whether or not to execute ink replenishment. Specifically, the determination is performed based on whether or not an instruction has been made through the operation unit 4 to replenish ink. In the case of executing ink replenishment (YES), the procedure transitions to step S12, and in the case of not executing ink replenishment (NO), the procedure returns to step S11.

Note that when the carriage 19 is at the position P1 and thereby a capping state has been entered, even if an attempt is made to move the plug member 50, the liquid replenishing port 43 and the plug body 52 cannot be separated from each other due to interference of the projection 110. Therefore, ink cannot be replenished from the outside via the liquid replenishing port 43 (see FIGS. 4 and 5).

Next, in step S12, the state transitions to a non-capping state. In addition, in step S13, the timer unit 150 is driven, and the length of time of a non-capping state is counted (measured).

Specifically, the driving motor of the carriage 19 is driven, and the carriage 19 is moved from the position P1 for a capping state to the position P2 for a non-capping state (moved in the +Y axis direction). In addition, at this time, the driving motor of the cap elevation unit 240 is driven, and the cap 14 is moved downward (the −Z axis direction) (FIGS. 6 and 7). Accordingly, the nozzles are released from the cap 14, and, additionally, the plug member 50 can be moved without being interfered with by the projection 110. By moving the plug member 50 upward, the liquid replenishing port 43 and the plug body 52 can be separated from each other (see FIG. 8).

In a non-capping state, the liquid tank 30 is then replenished with ink while the ink bottle that contains replenishing ink is abutted against the liquid replenishing port 43. At this time, the nozzles and the cap 14 are separated from each other, and thus the pressure when the ink bottle is abutted against the liquid replenishing port 43 is not applied to the cap 14. Therefore, when the ink bottle is separated (removed) from the liquid replenishing port 43, pressure is not applied on the nozzle side from the cap 14. Therefore, the nozzle meniscus formed in the nozzles is not subjected to pressure either, and the nozzle meniscus is maintained.

Next, in step S14, whether or not ink replenishment is complete is determined. Specifically, the determination is performed based on whether or not an instruction to end ink replenishment has been made through the operation unit 4. If ink replenishment is complete (YES), the procedure transitions to step S15, and if ink replenishment is not complete (NO), the procedure returns to step S14.

Next, in step S15, whether or not the length of time of the non-capping state is longer than or equal to a first predetermined time is determined. If the length of time of the non-capping state is longer than or equal to the first predetermined time (YES), the procedure transitions to step S16, and if the length of time of the non-capping state is shorter than the first predetermined time (NO), the procedure transitions to step S20.

Accordingly, in a non-capping state, the liquid tank 30 is replenished with ink, but, at this time, the liquid ejection head 12 is not covered by the cap 14, and thus ink dries and its viscosity increases, and there is a risk that a discharge failure will occur. Therefore, the first predetermined time is set, and if a discharge failure occurs, cleaning is executed. On the other hand, if the length of time of the non-capping state is not long enough to cause a discharge failure, it is determined that cleaning is unnecessary, and suppress wasted ink incurred by cleaning.

Note that the first predetermined time can be set as appropriate based on the ink type and the forms of the nozzles.

Next, in step S16, the state transitions to a capping state. Specifically, the driving motor of the carriage 19 is driven, and the carriage 19 is moved from the position P2 for a non-capping state to the position P1 for a capping state (the home position) (moved in the −Y axis direction). In addition, at this time, the driving motor of the cap elevation unit 240 is driven, and the cap 14 is moved upward (the +Z axis direction) (FIGS. 4 and 5). Accordingly, the nozzles of the liquid ejection head 12 are covered by the cap 14.

Next, in step S17, it is determined whether or not the length of time of the non-capping state is longer than or equal to a second predetermined time. If the length of time of the non-capping state is longer than or equal to the second predetermined time (YES), the procedure transitions to step S18 (first cleaning), and if the time of the non-capping state is shorter than the second predetermined time (NO), the procedure transitions to step S19 (second cleaning). Note that the length of time of the non-capping state being shorter than the second predetermined time is the length of time of the non-capping state being longer than or equal to the first predetermined time and shorter than the second predetermined time.

Even if the length of time of the non-capping state is longer than or equal to the first predetermined time, the second predetermined time that is longer than the first predetermined time is also set, the intensity of cleaning is determined, and appropriate cleaning is executed. The intensity of cleaning in this embodiment is defined based on a length of time during which the suction pump 16 sucks fluid (liquid or air) in the liquid ejection head 12. Therefore, the sucking time during first cleaning if the non-capping time is longer than or equal to the second predetermined time is set to be longer than the sucking time during second cleaning if the non-capping time is shorter than the second predetermined time. Accordingly, it is possible to execute appropriate cleaning, reduce discharge failures, and suppress wasted ink incurred by cleaning.

Next, in step S18, first cleaning is executed. Specifically, the suction pump 16 is driven. Accordingly, fluid (liquid or air) in the liquid ejection head 12 is sucked. The sucking time in this case can be set to about 2.5 seconds, for example.

In addition, in step S19, second cleaning is executed. Specifically, the suction pump 16 is driven. Accordingly, fluid (liquid or air) in the liquid ejection head 12 is sucked. The sucking time in this case can be set to about 0.3 seconds, for example.

Next, in step S20, the timer unit 150 is reset, and the procedure ends.

As described above, according to this embodiment, the following effects can be obtained.

The liquid tank 30 is replenished with ink in a non-capping state where the nozzles are not covered by the cap 14. Therefore, pressure is not applied to the nozzles, and the nozzle meniscus formed in the nozzles can be prevented from being broken. Accordingly, it is possible to suppress the occurrence of an ink discharge failure.

In addition, in a capping state, the plug member 50 and the projection 110 have a positional relationship in which the plug member 50 and the projection 110 interfere with each other, and thus the liquid replenishing port 43 and the plug body 52 cannot be separated from each other. Accordingly, in a capping state, ink replenishment cannot be executed, and thus the nozzle meniscus can be prevented from being broken in advance.

In addition, appropriate cleaning that is based on the length of time of the non-capping state can be executed. Therefore, it is possible to reduce discharge failures and suppress wasted ink incurred by cleaning.

Note that the invention is not limited to the above embodiment, and various modifications, improvements, and the like can be added to the above embodiment. Modified example will be described as follows.

Modified Example 1

In the above embodiment, in the case of a non-capping state, the carriage 19 is moved in the Y axis direction, but there is no limitation thereto. For example, a configuration may be adopted in which the carriage 19 is moved in the +Z axis direction relative to the cap 14. In addition, a configuration may also be adopted in which the cap 14 is moved in the −Z axis direction relative to the carriage 19. Also with such configurations, it is possible to separate the nozzles of the liquid ejection head 12 and the cap 14 from each other, and bring them into a non-capping state. Note that, in this case, the projection 110 may be omitted.

Modified Example 2

In the above embodiment, in the case of a non-capping state, the carriage 19 is moved in the Y axis direction, but there is no limitation thereto. For example, a configuration may be adopted in which the carriage 19 is moved in the X axis direction relative to the cap 14. In addition, a configuration may also be adopted in which the cap 14 is moved in the X axis direction relative to the carriage 19. Accordingly, the carriage 19 or the cap 14 may be moved relatively in the horizontal direction (the second direction intersecting the first direction). Also with such configurations, it is possible to separate the nozzles of the liquid ejection head 12 and the cap 14 from each other, and bring them into a non-capping state.

Modified Example 3

In the above embodiment, the projection 110 is formed so as to cover a portion of the plug member 50 in planar view, but there is no limitation thereto. For example, the projection 110 may be formed so as to cover the entire plug member 50 in planar view. With such a configuration, an effect similar to the above-described effect can be obtained.

Modified Example 4

In the above embodiment, the projection 110 is provided running along an upper face portion of the right side face (fifth face, fifth wall) 105, but there is no limitation thereto. For example, the projection 110 may be provided running along an upper face portion of the front face 103. Furthermore, it suffices for a projection to be provided at a position at which the projection interferes with an opening/closing operation of the plug member 50 in a capping state. Also with such a configuration, an effect similar to the above-described effect can be obtained.

Modified Example 5

In the above embodiment, a configuration in the case of one liquid tank 30 has been described, but there is no limitation thereto. For example, a liquid ejection apparatus in which a plurality of liquid tanks are mounted may be used. In this case, it suffices for a projection to be provided at a position at which the projection interferes with an opening/ closing operation of a plug member that covers liquid replenishing ports 43 provided for the respective liquid tanks.

In addition, in the case of replenishing a liquid tank with ink, it suffices for a carriage to be moved to a position at which a plug member corresponding to the liquid tank that is replenished with ink can be opened/closed. Also with such a configuration, an effect similar to the above-described effect can be obtained.

Modified Example 6

In the above embodiment, it is determined whether or not to execute ink replenishment, based on an operation made on the operation unit 4, but there is no limitation thereto. For example, whether or not to execute ink replenishment may be determined in conjunction with an opening/closing operation of the upper cover 6. In this case, it is sufficient that an open/closed state of the upper cover 6 is detected using a proximity sensor or the like. If an open state of the upper cover 6 is detected, it is determined that ink replenishment is to be executed, and if a closed state of the upper cover 6 is detected, it is determined that ink replenishment is not to be executed. Also with such a configuration, an effect similar to the above-described effect can be obtained.

Modified Example 7

In the above embodiment, the position of the carriage 19 at which a non-capping state is entered is a position at which the nozzles of the liquid ejection head 12 are opposed to the cap 14 (the home position), but there is no limitation thereto, and the position of the carriage 19 at which a non-capping state is entered may be a position at which the nozzles of the liquid ejection head 12 are not opposed to the cap 14 (a position other than the home position).

Modified Example 8

The invention is not limited to an inkjet printer and a liquid tank for supplying ink to an inkjet printer, and can also be applied to any liquid ejection apparatus that ejects liquid other than ink and a liquid tank for containing the liquid. For example, the invention can be applied to the following various liquid ejection apparatuses and liquid tanks thereof.

(1) Image recording apparatuses such as a facsimile apparatus, (2) Color material ejection apparatuses used to manufacture color filters for image display apparatuses such as a liquid crystal display, (3) Electrode material ejection apparatuses used to form electrodes for organic EL (Electro Luminescence) displays, surface light emission displays (field emission displays, FED), or the like.

(4) Liquid ejection apparatuses that eject liquid containing biological organic matter used to manufacture biochips, (5) Sample ejection apparatuses serving as precision pipettes, (6) Lubricating oil ejection apparatuses, (7) Resin liquid ejection apparatuses, (8) Liquid ejection apparatuses that perform pinpoint ejection of lubricating oil to precision machines such as a watch and a camera, (9) Liquid ejection apparatuses that eject transparent resin liquid such as UV-cured resin liquid onto substrates in order to form micro-hemispherical lenses (optical lenses) or the like used in optical communication elements or the like,

(10) Liquid ejection apparatuses that eject acid or alkaline etchant in order to etch substrates or the like, and

(11) Liquid ejection apparatuses that include liquid ejection heads for discharging a very small amount of any other kinds of droplet.

Note that "droplet" refers to a state of a liquid discharged from a liquid ejection apparatus, and includes droplets having a granular shape, a tear-drop shape, and a shape with a thread-like trailing end. In addition, the "liquid" mentioned here need only be a material, which can be ejected by a liquid ejection apparatus. For example, the "liquid" need only be a material in a state where a substance is in a liquid phase, and a liquid material having a high or low viscosity, sol, gel water, and other liquid materials such as an inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. In addition, representative examples of the liquid include ink such as that described in the above embodiment, liquid crystal, or the like. Here, the "ink" encompasses general water-based ink and oil-based ink, as well as various types of liquid compositions such as gel ink and hot melt ink.

This application claims the benefit of foreign priority to Japanese Patent Application No. JP2017-224385, filed Nov. 22, 2017, which is incorporated by reference in its entirety.

What is claimed is:

1. A liquid ejection apparatus comprising:

a liquid ejection head that has a nozzle configured to eject a liquid;

a liquid container that has a liquid replenishing port that is in communication with the liquid ejection head, and through which the liquid is replenished from an external container;

a plug member that can close the liquid replenishing port by being positioned at a closing position and open the liquid replenishing port by being positioned at an open position;

a carriage configured to arrange the liquid ejection head and the liquid container;

a cap configured to cap the nozzle so as to cover the nozzle; and a control unit, assuming that a state where the nozzle is covered by the cap is a capping state and a state where the nozzle is not covered by the cap is a non-capping state, configured to bring the nozzle and the cap into the non-capping state before removing the external container from the liquid replenishing port.

2. The liquid ejection apparatus according to claim 1, wherein the carriage is configured to reciprocally move in a first direction, and before removing the external container from the liquid replenishing port, the control unit moves the carriage in the first direction to a position at which the nozzle and the cap come into a non-capping state.

3. The liquid ejection apparatus according to claim 2, wherein, before removing the external container from the liquid replenishing port, the control unit further moves the carriage or the cap in a second direction that intersects the first direction, to a position at which the nozzle and the cap come into a non-capping state.

4. The liquid ejection apparatus according to claim 2, further comprising:

a housing that interferes with at least a portion of the plug member in the capping state in order to hinder opening/ closing of the plug member, and does not interfere with the plug member in the non-capping state.

5. The liquid ejection apparatus according to claim 1, wherein the carriage is configured to reciprocally move in a first direction, and before removing the external container from the liquid replenishing port, the control unit moves the carriage or the cap in a second direction that intersects the first direction to a position at which the nozzle and the cap come into a non-capping state.

6. The liquid ejection apparatus according to claim 1, further comprising:

a timer that counts a non-capping time during which the nozzle and the cap are in the non-capping state, wherein the control unit determines whether or not it is necessary to clean the nozzle and a cleaning intensity according to the non-capping time counted by the timer, and executes cleaning.

* * * * *